US011255627B1

(12) United States Patent
Nishihira

(10) Patent No.: US 11,255,627 B1
(45) Date of Patent: Feb. 22, 2022

(54) CABLE AND BOW

(71) Applicant: Ternarc Inc., Okayama (JP)

(72) Inventor: Morikazu Nishihira, Kurashiki (JP)

(73) Assignee: Ternarc Inc., Okayama (JP)

( * ) Notice: Subject to any disclaimer, the term of this patent is extended or adjusted under 35 U.S.C. 154(b) by 0 days.

(21) Appl. No.: 17/204,939

(22) Filed: Mar. 18, 2021

(30) Foreign Application Priority Data

Nov. 9, 2020 (JP) ..... JP2020-186275

(51) Int. Cl.
*F41B 5/14* (2006.01)
*F41B 5/10* (2006.01)

(52) U.S. Cl.
CPC ..... *F41B 5/105* (2013.01); *F41B 5/1411* (2013.01)

(58) Field of Classification Search
CPC ..... F41B 5/10; F41B 5/105; F41B 5/1411; Y10S 124/90
USPC ..... 124/25.6, 90, 900
See application file for complete search history.

(56) References Cited

U.S. PATENT DOCUMENTS 4,524,750 A * 6/1985 Darlington ..... F41B 5/1411 124/25.6
4,702,067 A * 10/1987 Izuta ..... D01F 6/04 57/243
4,993,399 A * 2/1991 Chattin ..... F41B 5/10 124/25.6
5,054,463 A * 10/1991 Colley ..... F41B 5/105 124/25.6
5,322,049 A * 6/1994 Dunlap ..... D07B 1/18 124/90
5,598,831 A * 2/1997 Izuta ..... F41B 5/1411 124/90
5,623,915 A * 4/1997 Kudlacek ..... F41B 5/10 124/25.6
5,715,804 A * 2/1998 Izuta ..... F41B 5/1411 124/90
5,884,617 A * 3/1999 Nelson ..... F41B 5/1411 124/90
6,688,295 B1 * 2/2004 Miller ..... F41B 5/10 124/25.6
6,729,320 B1 * 5/2004 Terry ..... F41B 5/10 124/25.6

(Continued)

FOREIGN PATENT DOCUMENTS

JP S55-33507 A 3/1980

*Primary Examiner* — Alexander R Niconovich
(74) *Attorney, Agent, or Firm* — Yokoi & Co., U.S.A.; Toshiyuki Yokoi

(57) ABSTRACT

A cable tensed between a pair of large and small diameter cams of a bow and elastically deformed to generate an elastic force for rotating the pair of large and small diameter cams and a pair of string cams rotated integrally with the pair of large and small diameter cams in a reverse direction when the string is drawn to rotate the pair of large and small diameter cams are rotated. The cable has: a first high-elasticity raw thread wound around one of the pair of large and small diameter cams; a second high-elasticity raw thread wound around the other of the pair of large and small diameter cams; and a low-elasticity raw thread which connects the first high-elasticity raw thread with the second high-elasticity raw thread, the low-elasticity raw thread being elastically deformed more easily than the first high-elasticity raw thread and the second high-elasticity raw thread.

4 Claims, 7 Drawing Sheets

(56) References Cited

U.S. PATENT DOCUMENTS

| | | | | |
|---|---|---|---|---|
| 7,441,555 | B1 * | 10/2008 | Larson | F41B 5/10 124/25.6 |
| 8,181,638 | B1 * | 5/2012 | Yehle | F41B 5/105 124/25.6 |
| 8,522,762 | B2 * | 9/2013 | Trpkovski | F41B 5/1453 124/25.6 |
| 8,826,894 | B1 * | 9/2014 | Darlington | F41B 5/105 124/25.6 |
| 9,459,066 | B2 * | 10/2016 | Evans | F41B 5/105 |
| 9,612,076 | B2 * | 4/2017 | Griggs | F41B 5/1411 |
| 10,126,090 | B1 * | 11/2018 | Abernethy | F41B 5/1415 |
| 10,156,417 | B1 * | 12/2018 | Jolley | F41B 5/1411 |
| 10,746,496 | B2 * | 8/2020 | Nishihira | F41B 5/10 |
| 10,989,492 | B1 * | 4/2021 | Kempf | F41B 5/105 |
| 2007/0101980 | A1 * | 5/2007 | Sims | F41B 5/10 124/25.6 |
| 2012/0152219 | A1 * | 6/2012 | McPherson | F41B 5/1411 124/25 |
| 2013/0306046 | A1 * | 11/2013 | Ady | F41B 5/1411 124/25.6 |
| 2014/0261366 | A1 * | 9/2014 | McPherson | D02G 3/444 124/90 |

* cited by examiner

CABLE AND BOW

CROSS-REFERENCES TO RELATED APPLICATIONS

This patent specification is based on Japanese patent application, No. 2020-186275 filed on Nov. 9, 2020 in the Japan Patent Office, the entire contents of which are incorporated by reference herein.

BACKGROUND OF THE INVENTION

1. Field of the Invention

The present invention relates to a cable and a bow.

2. Description of Related Art

In some bows, an arrow is shot by an elastic energy of a cable by drawing a string to elastically deform the cable without elastically deforming a limb.

For example, Patent Document 1 discloses a bow having a pair of string cams arranged on both ends of a bow body so that a string for shooting an arrow is wound around the string cams and a pair of cable cams arranged on both ends of the bow body and rotated interlockingly with the string cams to elastically deform cables.

[Patent Document 1] Japanese Patent No. 6666536

BRIEF SUMMARY OF THE INVENTION

In the bow disclosed in Patent Document 1, the cables are wound around each of the cable cams. The cables are elastically deformed not only at an intermediate portion between the cable cams but also at the portion wound around the cable cams when the cables are pulled. Accordingly, when the string is drawn and the cable cams which are integrated with the string cams are rotated, the portion wound around the cable cams may be largely elastically deformed. In such a case, the cables are slipped on the cable cams and friction loss is generated. As a result, it may become difficult to let the arrow fly to a further distance because of energy loss.

The present invention provides a cable and a bow capable of preventing the slippage between the cable and the cable cam and capable of letting the arrow fly to a further distance.

In a cable of a bow concerning the first viewpoint of the present invention, the bow includes: a pair of string cams around which both ends of a string for nocking an arrow are wound so that the pair of string cams are rotated when the string is drawn; and a pair of cable cams configured to be rotated integrally with each of the pair of string cams, the cable being tensed between the pair of cable cams and configured to be elastically deformed to generate an elastic force for rotating the pair of cable cams and the pair of string cams rotated integrally with the pair of cable cams in a reverse direction when the string is drawn to rotate the pair of cable cams, the cable includes: a first high-elasticity raw thread wound around one of the pair of cable cams; a second high-elasticity raw thread wound around the other of the pair of cable cams; and a low-elasticity raw thread which connects the first high-elasticity raw thread with the second high-elasticity raw thread, the low-elasticity raw thread being elastically deformed more easily than the first high-elasticity raw thread and the second high-elasticity raw thread.

It is preferred that the low-elasticity raw thread is connected with the first high-elasticity raw thread at a position separated from the one of the pair of cable cams and connected with the second high-elasticity raw thread at a position separated from the other of the pair of cable cams.

The cable can further include a first connection pin for connecting the first high-elasticity raw thread with the low-elasticity raw thread by winding the first high-elasticity raw thread and the low-elasticity raw thread around the first connection pin; and a second connection pin for connecting the second high-elasticity raw thread with the low-elasticity raw thread by winding the second high-elasticity raw thread and the low-elasticity raw thread around the second connection pin.

The first high-elasticity raw thread and the low-elasticity raw thread can be alternately wound in an axial direction of the first connection pin, and the second high-elasticity raw thread and the low-elasticity raw thread can be alternately wound in an axial direction of the second connection pin.

A bow concerning the second viewpoint of the present invention includes: a pair of string cams around which both ends of a string for nocking an arrow are wound so that the pair of string cams are rotated when the string is drawn; and a pair of cable cams around which both ends of a cable are wound so that the pair of cable cams is configured to be rotated integrally with each of the pair of string cams, the cable includes: a first high-elasticity raw thread wound around one of the pair of cable cams; a second high-elasticity raw thread wound around the other of the pair of cable cams; and a low-elasticity raw thread which connects the first high-elasticity raw thread with the second high-elasticity raw thread, the low-elasticity raw thread being elastically deformed more easily than the first high-elasticity raw thread and the second high-elasticity raw thread, wherein the cable is configured to be elastically deformed to generate an elastic force for rotating the pair of cable cams and the pair of string cams rotated integrally with the pair of cable cams in a reverse direction when the string is drawn to rotate the pair of cable cams.

By using the configuration of the present invention, since the first high-elasticity raw thread is wound around one of the pair of cable cams and the second high-elasticity raw thread is wound around the other of the pair of cable cams, the slippage between the cable and the cable cam is less frequently generated compared to the case where the low-elasticity raw thread is wound around the cable cam. Consequently, the rotation of the cable cam is converted into the elastic deformation of the low-elasticity raw thread connected with the first high-elasticity raw thread and the second high-elasticity raw thread more efficiently. As a result, the cable of the present invention can let the arrow fly to a further distance.

DETAILED DESCRIPTION OF THE INVENTION

Figure 1:
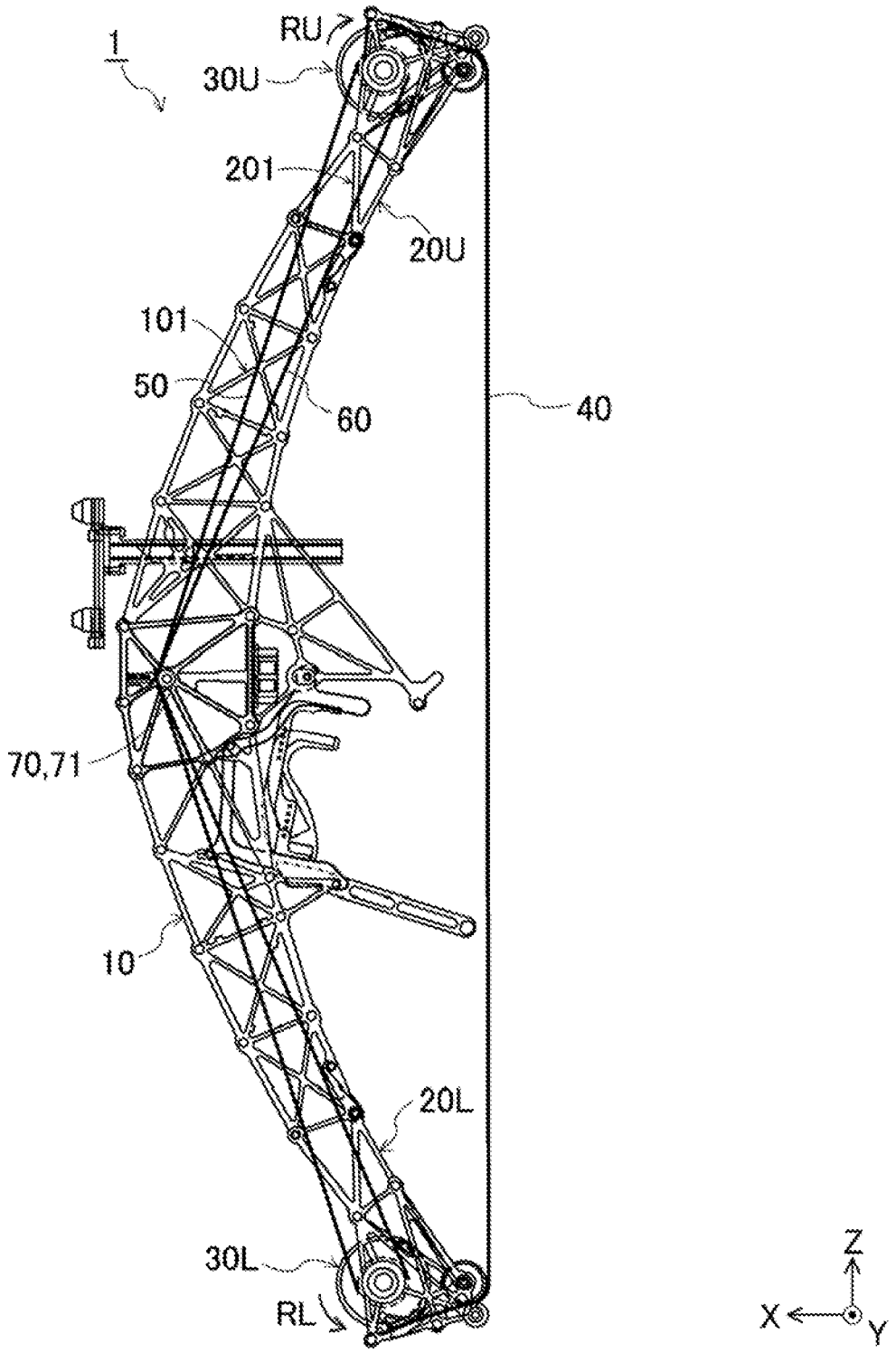
FIG. 1 is a side view of a bow concerning an embodiment of the present invention.

Hereafter, the bow concerning the embodiments of the present invention will be explained in detail with reference to the drawings. Note that the same reference sign is added to the same or similar configuration in the drawings. In the orthogonal coordinate system XYZ shown in the drawings, when a bow body having an arc-shape is directed in a vertical direction and an arrow is shot frontward, the vertical direction is the z direction, the front-back direction is X direction, and the direction orthogonal to the Z direction and the X direction is the Y direction. Hereafter, the above described coordinate system is arbitrarily used in the explanation.

A bow concerning the embodiment of the present invention is the bow that does not have limbs and shoots an arrow by elastically deforming cables instead of the limbs. In the above described bow, the cables are wound around a large diameter cam and a small diameter cam (i.e., an embodiment of the cable cams), and the cables are formed of the high-elasticity raw thread and the low-elasticity raw thread for preventing the cables from slipping on the large diameter cam and the small diameter cam. First, the configuration of the whole bow will be explained with reference to FIG. 1 and FIGS. 2A to 2C.

Figure 2A:
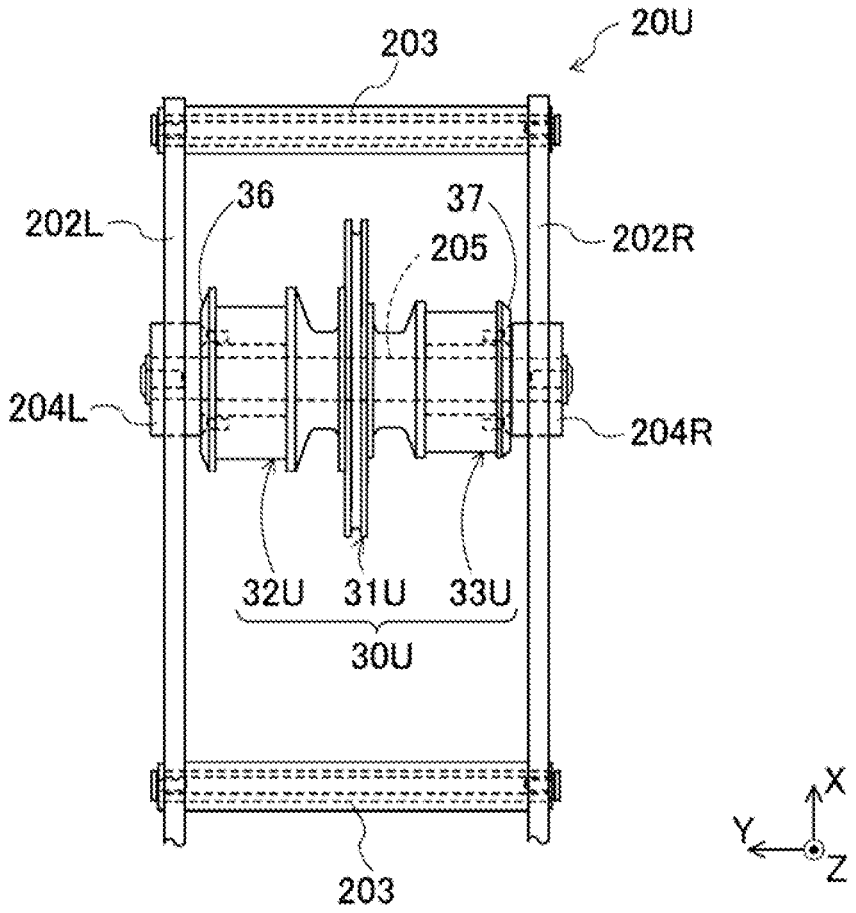
FIG. 2A is an enlarged plan view of an upper end portion of a reel and a holder provided with a bow 1.
Figure 2B:
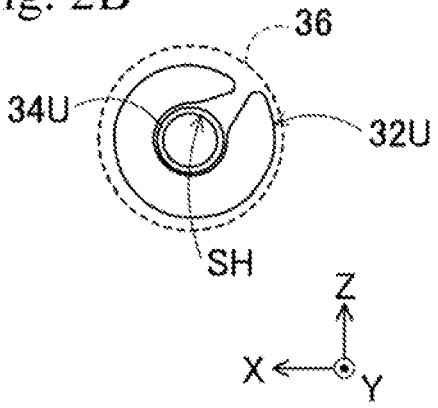
FIG. 2B is a left side view of a large diameter cam provided with the reel.
Figure 2C:
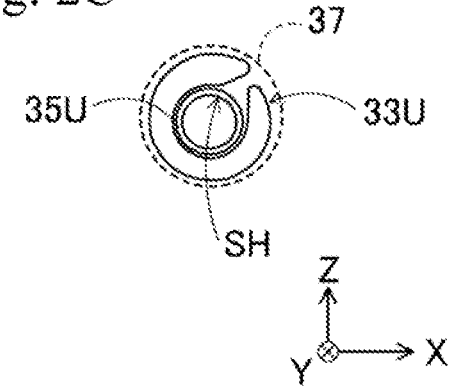
FIG. 2C is a right side view of a small diameter cam provided with the reel.

FIG. 1 is a side view of a bow 1 concerning an embodiment of the present invention. FIG. 2A is an enlarged plan view of an upper end portion of a reel 30U and a holder 20U provided with the bow 1. FIG. 2B is a left side view of a large diameter cam 32U provided with the reel 30U. FIG. 2C is a right side view of a small diameter cam 33U provided with the reel 30U.

Note that cables 50, 60 are shown assuming that the cables 50, 60 are located at the left side surface of a bow body 10 and the holders 20U, 20L in FIG. 1 for clarifying the position. In FIG. 2A, a string 40 and the cables 50, 60 are omitted for facilitating the understanding. In addition, FIG. 2B illustrates the large diameter cam 32U in a state that a rotary shaft 205 is detached from the reel 30U shown in FIG. 2A and a disk-shaped lid 36 provided on the left side surface of the large diameter cam 32U is detached. Similarly, FIG. 2C illustrates the small diameter cam 33U in a state that the rotary shaft 205 is detached from the reel 30U and a disk-shaped lid 37 provided on the right side surface of the small diameter cam 33U is detached.

As shown in FIG. 1, the bow 1 has a bow body 10, holders 20U, 20L provided on the upper end and lower end of the bow body 10 respectively, reels 30U, 30L which are supported by the holders 20U, 20L so that the string 40 and the cables 50, 60 are tensed between the reels 30U, 30L.

The bow body 10 is formed in a circular-arc plate shape. A large number of triangle-shaped notches 101 is formed on the above described plate surface. Consequently, the bow body 10 has a plane truss structure. As a result, the bow body 10 has high rigidity and the bow body 10 is hardly deformed even when the later described cables 50, 60 are elastically deformed.

In addition, the holders 20U, 20L for holding the reels 30U, 30L to which the string 40 and the cables 50, 60 are tensed are mounted on the upper end and the lower end of the bow body 10.

The holders 20U, 20L are formed in a plate shape of a concave pentagon recessed in a shorter direction in a side view. The upper end or the lower end in a longitudinal direction of the holders 20U, 20L is connected with the bow body 10. Similar to the bow body 10, the holders 20U, 20L have a plane truss structure including a large number of triangular shapes. Thus, the holders 20U, 20L have high rigidity.

Although it is not illustrated, the bow body 10 is assembled by arranging two circular-arc plates in the lateral (left/right) direction and connecting them by a connecting rod. Each of the holders 20U, 20L has two concave pentagonal plates since the holders 20U, 20L are connected with the bow body 10 having the above described structure.

In detail, as shown in FIG. 2A, the holder 20U has plates 202R, 202L which are arranged in the lateral direction (i.e., Y-direction) and connected by a connecting rod 203. In addition, although it is not illustrated, the holder 20L also has the plates 202R, 202L connected by the connecting rod 203.

Note that the holder 20L has the same configuration as the holder 20U except for that they are formed symmetrically to each other in the vertical direction. Accordingly, the configuration of the holder 20U will be explained and the explanation of the holder 20L will be omitted in the specification of the present invention.

Not illustrated through hole is formed in the plates 202R, 202L and bearings 204R, 204L shown in FIG. 2A are fitted to the through hole. The bearings 204R, 204L rotatably hold the rotary shaft 205 which penetrates thorough the reel 30U in the lateral direction. Consequently, the plates 202R, 202L rotatably hold the reel 30U.

The reel 30U has a string cam 31U, a large diameter cam 32U and a small diameter cam 33U for winding the string 40 and the cables 50, 60 around the string cam 31U, the large diameter cam 32U and the small diameter cam 33U respectively.

Here, the string 40 is a member for nocking the arrow on it. The whole string 40 is formed of thread (i.e., high-elasticity raw thread) which is hardly elastically deformed and hardly extended for correctly transferring the drawing weight to the reel 30U. On the other hand, the cables 50, 60 are members to be elastically deformed instead of the limbs which are provided on a normal bow. Although the detailed configuration of the cables 50, 60 will be described later, a part of the cables 50, 60 are formed of the thread (i.e., low-elasticity raw thread) having the lower elastic modulus compared to the thread of the string 40 so that the cables 50, 60 are elastically deformed by the rotation of the reel 30U easily.

Although it is not illustrated, the string cam 31U, the large diameter cam 32U and the small diameter cam 33U are formed in a non-circular plate shape. In detail, they are formed in a plate shape where curved surfaces having different curvatures are connected in the circumferential direction. A concave portion (i.e., groove) is formed on an outer periphery of the circular plate of them, and the string 40 and the cables 50, 60 are wound around the groove. Note that the large diameter cam 32U and the small diameter cam 33U are also referred to as a cable cam in the specification of the present invention.

In addition, as shown in FIG. 2A, the outer diameters of the string cam 31U, the large diameter cam 32U and the small diameter cam 33U are increased in this order. The large diameter cam 32U, the string cam 31U and the small diameter cam 33U are arranged in this order from the left side (i.e., from +Y side). The string cam 31U, the large diameter cam 32U and the small diameter cam 33U are coaxially and integrally combined. Consequently, when the string 40 is drawn and the string cam 31U is rotated in a direction RU shown in FIG. 1, the large diameter cam 32U and the small diameter cam 33U are rotated in the same direction as the string cam 31U interlockingly with the string cam 31U. Although it is not illustrated, the direction RU is the opposite direction to the winding direction of the cable 50 wound to the large diameter cam 32U and the same direction as the winding direction of the cable 60 wound to the small diameter cam 33U. As a result, by the rotation in the direction RU, the large diameter cam 32U winds the cable 50 and the small diameter cam 33U feeds the cable 60.

On the other hand, the reel 30L shown in FIG. 1 is formed in a vertically and horizontally reversed shape with the reel 30U. In detail, although it is not illustrated, the reel 30L has a string cam, a large diameter cam and a small diameter cam having the same shape as the string cam 31U, the large diameter cam 32U and the small diameter cam 33U respectively. The small diameter cam, the string cam and the large diameter cam are arranged in this order from the +Y side. Furthermore, the cable 50 are wound around the small diameter cam and the string 40 is wound around the string cam. In addition, the cable 60 are wound around the large diameter cam. Namely, both ends of the cables 50, 60 are wound around the small diameter cam and the large diameter cam. Consequently, when the string 40 is drawn, the string cam, the small diameter cam and the large diameter cam are interlocked with each other and rotated in a direction RL shown in FIG. 1. Although it is not illustrated, the direction RL is the same direction as the winding direction of the cable 50 wound to the small diameter cam and the opposite direction of the winding direction of the cable 60 wound to the large diameter cam. As a result, the small diameter cam feeds the cable 50 and the large diameter cam winds the cable 60.

At this time, the amount of feeding the cable 50 from the small diameter cam of the reel 30L is less than the amount of winding the cable 50 by the above described large diameter cam 32U of the reel 30U. In addition, the amount of winding the cable 60 by the large diameter cam of the reel 30L is more than the amount of feeding the cable 60 from the small diameter cam 33U of the reel 30U. Consequently, the cables 50, 60 are pulled and elastically deformed. As a result, when the string 40 is drawn and then released, the reels 30U, 30L are rotated in a reverse direction by the elastic force of the cables 50, 60 and the arrow nocked on the string 40 is shot.

As described above, the reels 30U, 30L elastically deform the cables 50, 60 by the force of drawing the string 40 and the force of drawing the string 40 is converted into the force of shooting the arrow. Namely, the cables 50, 60 are elastically deformed when the pair of large diameter cam 32U and small diameter cam 33U are rotated to generate an elastic force for rotating the pair of large diameter cam 32U and small diameter cam 33U and the pair of string cams rotated integrally with the pair of large diameter cam 32U and small diameter cam 33U in a reverse direction which is a direction opposite to the rotating direction when the string 40 is drawn.

In the reels 30U, 30L, in order to tense the above described elastically deformable cables 50, 60, rings are provided on both ends of the cables 50, 60 and bobbins 34U, 35U shown in FIG. 2B and FIG. 2C inserted into the rings are housed in cylindrical inner spaces provided on the large diameter cam 32U and the small diameter cam 33U in a state that the rotary shaft 205 is inserted through a shaft hole SH. Furthermore, although it is not illustrated, the cables 50, 60 extending from the bobbins 34U, 35U are drawn out from the openings communicating through the inner space of the large diameter cam 32U and the small diameter cam 33U, and the drawn cables 50, 60 are wound around the grooves provided on the outer periphery of the large diameter cam 32U and the small diameter cam 33U.

When the cables 50, 60 are wound, it can be considered that the whole cables 50, 60 are formed of the low-elasticity raw thread for elastically deforming the cables 50, 60 easily.

However, if the whole cables 50, 60 are formed of the low-elasticity raw thread, when the large diameter cam 32U and the small diameter cam 33U are rotated, the cables 50, 60 are elastically deformed even at the portion where the cables 50, 60 are wound around the grooves of the large diameter cam 32U and the small diameter cam 33U. As a result, the cables 50, 60 may be slipped at the grooves of the large diameter cam 32U and the small diameter cam 33U and friction loss is generated. Consequently, the cables 50, 60 cannot follow the rotation of the large diameter cam 32U and the small diameter cam 33U. Thus, conversion efficiency of converting the movement of drawing the string 40 into the movement of shooting the arrow may be deteriorated. In this case, it becomes difficult to let the arrow fly to a further distance.

Therefore, the cables 50, 60 are formed of the high-elasticity raw thread and the low-elasticity raw thread in the bow 1 for increasing the conversion efficiency of the movement for letting the arrow fly to a further distance. Then, the configurations of the cables 50, 60 will be explained with reference to FIG. 3 to FIG. 9.

Figure 3:
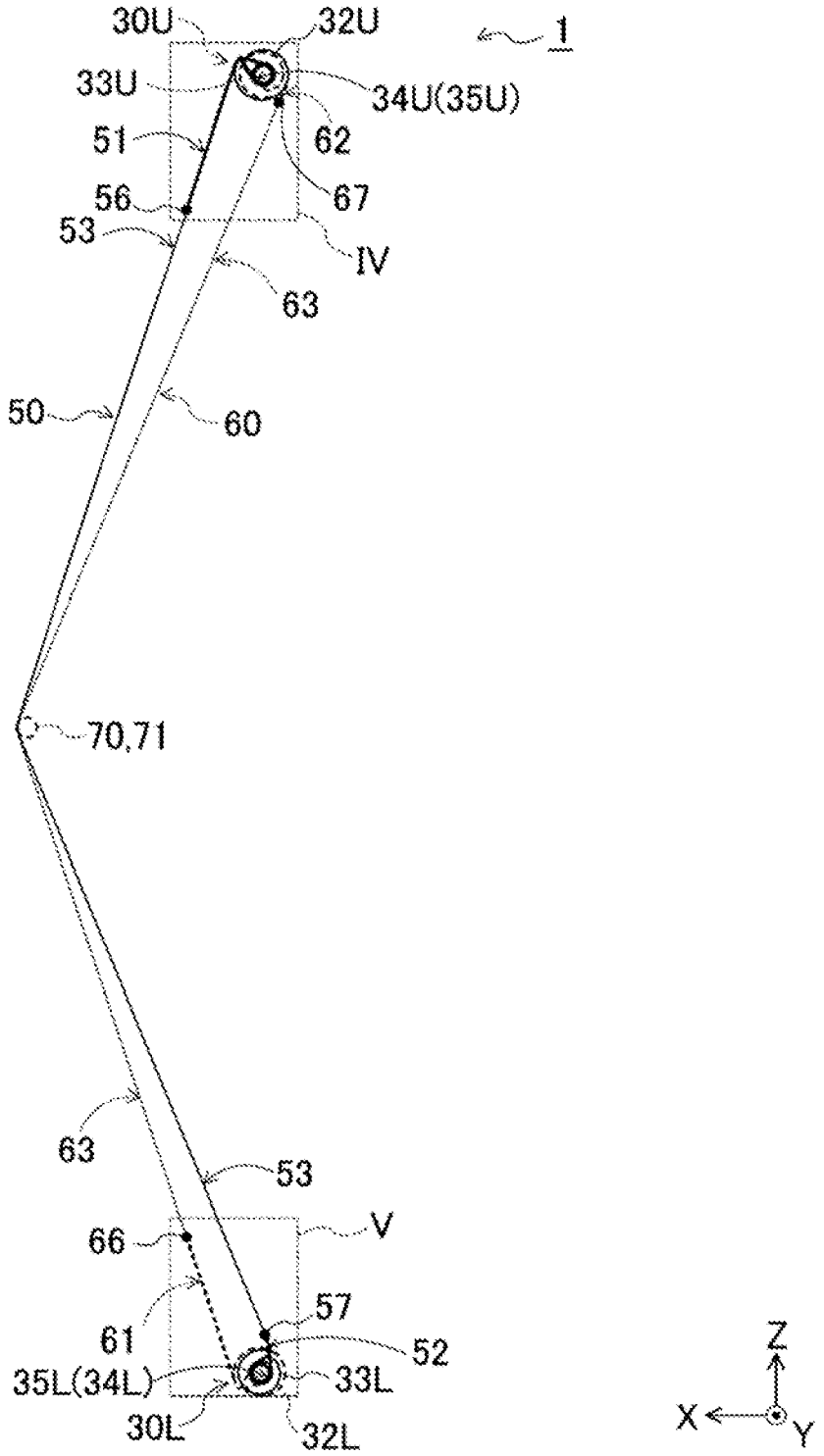
FIG. 3 is a side view of the cable provided with the bow.
Figure 4:
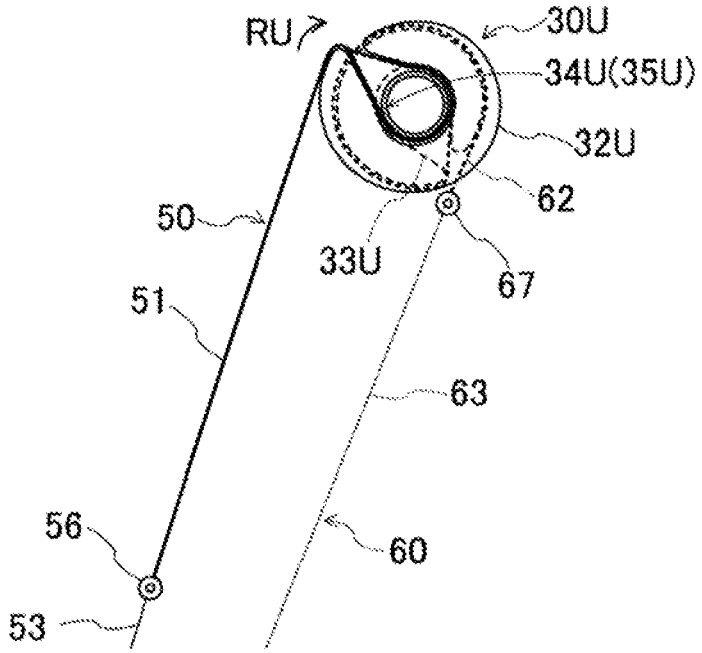
FIG. 4 is an enlarged view of IV area shown in FIG. 3.
Figure 5:
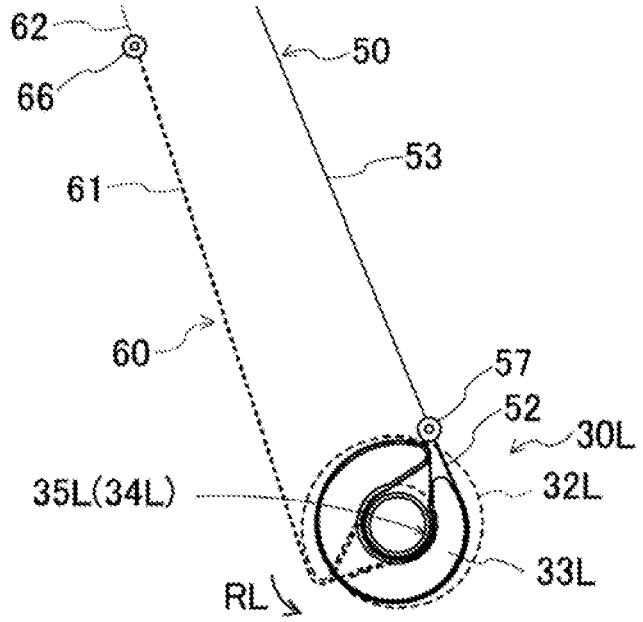
FIG. 5 is an enlarged view of V area shown in FIG. 3.
Figure 6:
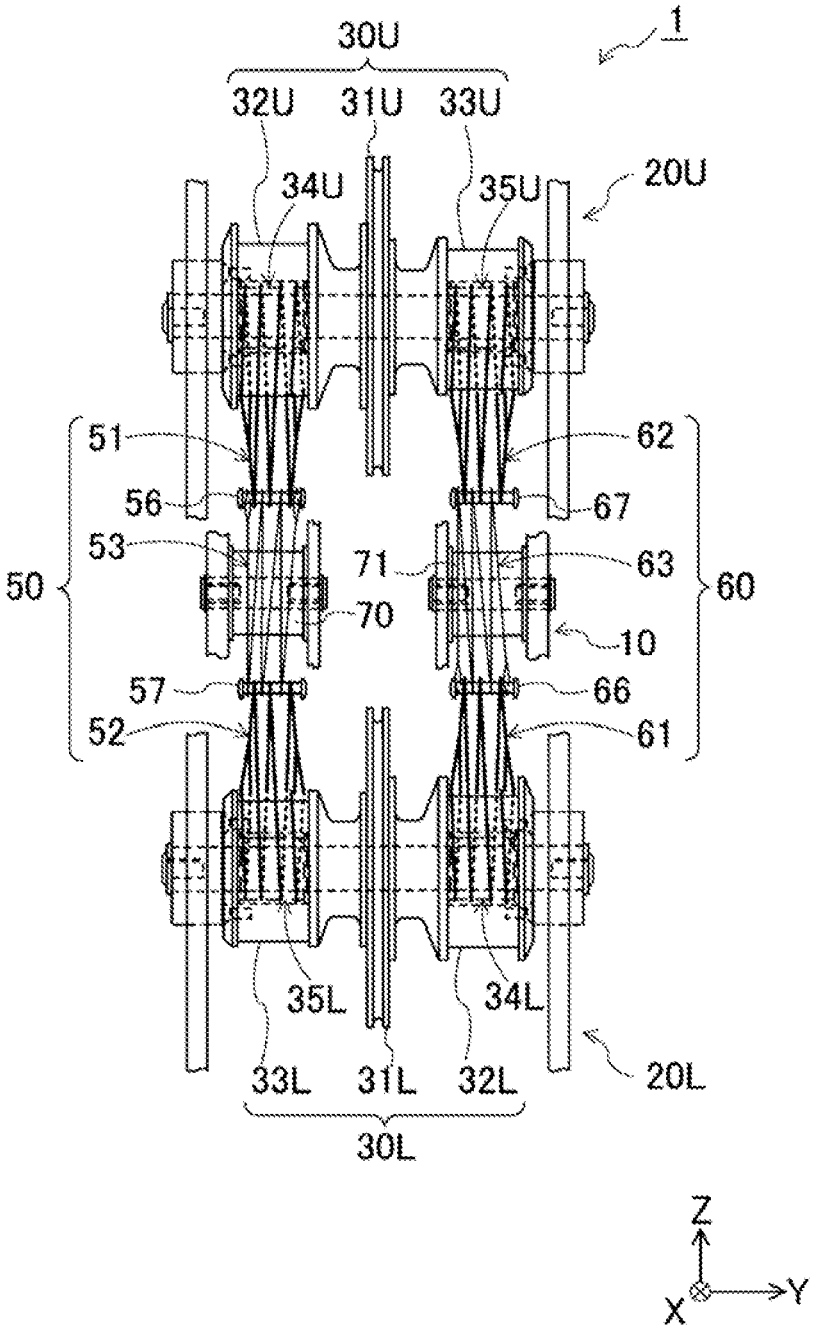
FIG. 6 is a conceptual diagram for showing the method of winding the cable around the reel.
Figure 7:
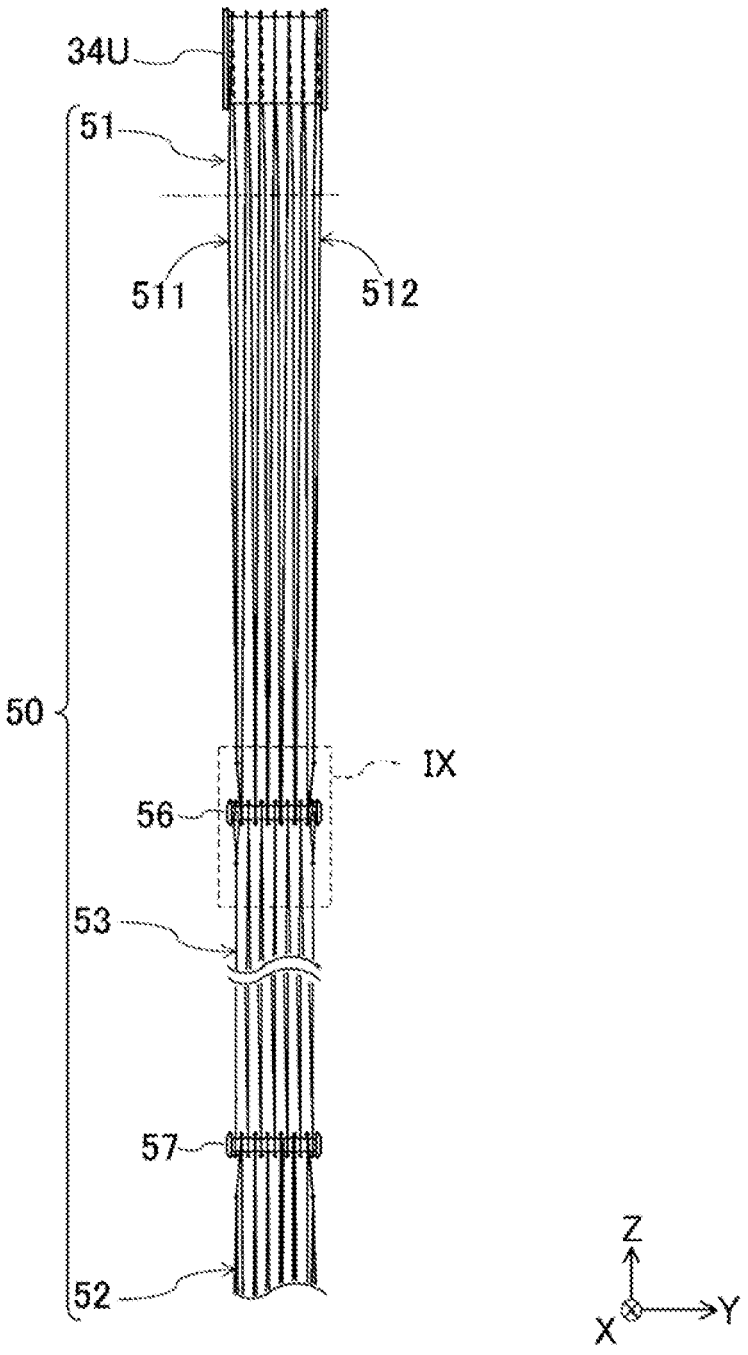
FIG. 7 is a front view of the cable wound around a bobbin, a first connection pin and a second connection pin.
Figure 8:
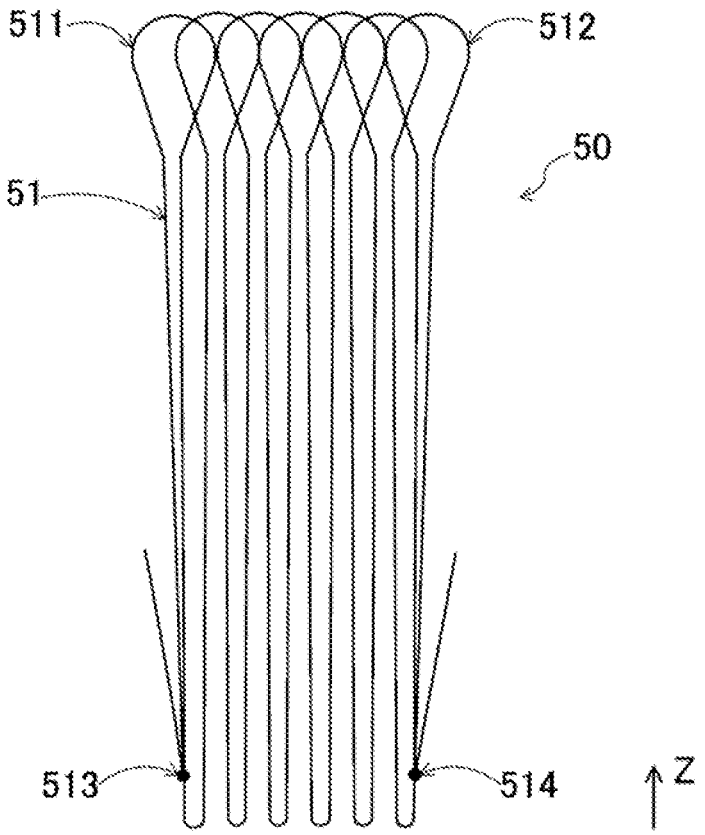
FIG. 8 is a conceptual diagram for showing the method of winding the cable.
Figure 9:
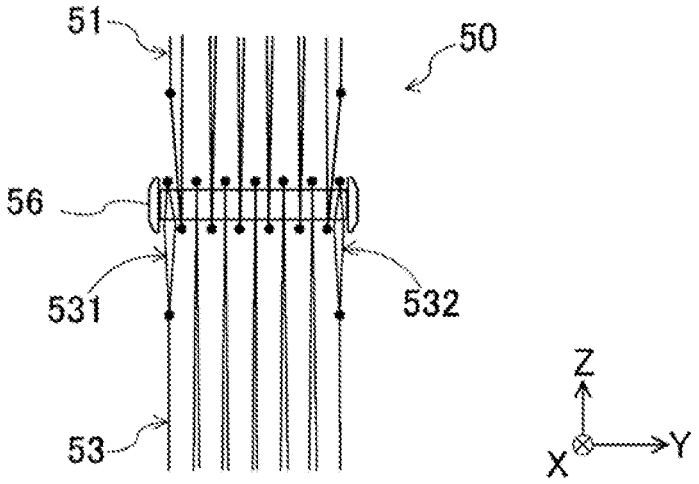
FIG. 9 is an enlarged view of IX area shown in FIG. 7.

FIG. 3 is a side view of the cables 50, 60 provided with the bow 1. FIG. 4 is an enlarged view of IV area shown in FIG. 3. FIG. 5 is an enlarged view of V area shown in FIG. 3. FIG. 6 is a conceptual diagram for showing the method of winding the cables 50, 60 around the reels 30U, 30L. FIG. 7 is a front view of the cable 50 wound around a bobbin 34U, a first connection pin 56 and a second connection pin 57. FIG. 8 is a conceptual diagram for showing the method of winding the cable 50. FIG. 9 is an enlarged view of IX area shown in FIG. 7.

Note that the reels 30U, 30L are shown in a state of being cut in the vertical direction in FIG. 3 for showing the method of winding the cables 50, 60. In addition, the string cams 31U, 31L of the reels 30U, 30L are omitted for facilitating the understanding. Furthermore, the cable 60 is shown by dot lines for distinguishing the cable 60 from the cable 50. In FIG. 4 and FIG. 5, the rotation direction (directions RU, RU) of the reels 30U, 30L for elastically deforming the cables 50, 60 and accumulating the energy is shown. In FIG. 6, only a part in the vertical direction of the bow body 10 and the holders 20U, 20L is shown and the whole cables 50, 60 are reduced in the vertical direction. In FIG. 8, the rings and bent portions provided on the cables 50, 60 are emphasized in size.

As shown in FIG. 3 to FIG. 5, the cable 50 has a first high-elasticity raw thread 51 wound around the bobbin 34U which is mounted on the large diameter cam 32U of the reel 30U, a second high-elasticity raw thread 52 wound around a bobbin 35L mounted on a small diameter cam 33L of the reel 30L, and a low-elasticity raw thread 53 arranged between the first high-elasticity raw thread 51 and the second high-elasticity raw thread 52 to connect the first high-elasticity raw thread 51 with the second high-elasticity raw thread 52.

The first high-elasticity raw thread 51 is provided for preventing (suppressing) the cable 50 from slipping on the reel 30U when the cable 50 is mounted on the reel 30U. As shown in FIG. 7, the first high-elasticity raw thread 51 is wound around the bobbin 34U and the first connection pin 56 by a plurality of times.

In detail, rings 511, 512 are formed on both ends of the first high-elasticity raw thread 51 as shown in FIG. 8. In the rings 511, 512, a cylindrical portion of the bobbin 34U is inserted into the ring 511 as shown in FIG. 7. As shown in FIG. 8, the first high-elasticity raw thread 51 extending from the ring is tensed downward (i.e., −Z direction) and then bent in a U-shape to extend in +Z direction. As shown in FIG. 7, the portion bent in the U-shape is wound around a columnar surface of the first connection pin 56. Furthermore, the first high-elasticity raw thread 51 is tensed in +Z direction and then bent in a ring-shape to extend in −Z direction again as shown in FIG. 8. As shown in FIG. 7, the portion bent in the ring-shape is wound around the columnar surface of the bobbin 34U. As shown in FIG. 7 and FIG. 8, the first high-elasticity raw thread 51 is then bent in U-shape to be wound around the columnar surface of the first connection pin 56 and further bent in ring-shape to be wound around the columnar surface of the bobbin 34U. Thus, the winding is repeated as described above. The first high-elasticity raw thread 51 is fixed to the bobbin 34U by inserting the cylindrical portion of the bobbin 34U into the above described ring 512. As described above, the first high-elasticity raw thread 51 is wound around the bobbin 34U and the first connection pin 56.

In addition, as shown in FIG. 7, the position of winding the first high-elasticity raw thread 51 is displaced in a cylindrical axial direction of the bobbin 34U or in a cylindrical axial direction of the first connection pin 56 from the previous position each time when the first high-elasticity raw thread 51 is wound around the bobbin 34U or the first connection pin 56. Consequently, the tensile force of the whole first high-elasticity raw thread 51 is uniformized to prevent the damage.

The first high-elasticity raw thread 51 is wound around the bobbin 34U and the first connection pin 56. Thus, the first high-elasticity raw thread 51 connects the bobbin 34U with the first connection pin 56. As shown in FIG. 3, FIG. 4 and FIG. 6, the bobbin 34U is mounted on the large diameter cam 32U of the reel 30U. In this state, the first high-elasticity raw thread 51 is wound on the groove formed on an outer peripheral surface of the large diameter cam 32U. Consequently, the first high-elasticity raw thread 51 transmits the rotation of the large diameter cam 32U to the first connection pin 56.

As shown in FIG. 6, the first connection pin 56 has a columnar shape with disks having a larger diameter than that of the column on both ends for preventing the threads from removing when the threads are wound. The above described first high-elasticity raw thread 51 is wound around the column. In addition, although it will be described later, the low-elasticity raw thread 53 is wound around the first connection pin 56. Consequently, the first connection pin 56 connects the first high-elasticity raw thread 51 and the low-elasticity raw thread 53 with each other.

In addition, the first connection pin 56 is arranged at the position separated from the large diameter cam 32U. Consequently, the low-elasticity raw thread 53 connected with the first connection pin 56 is prevented from being wound around the large diameter cam 32U and prevented from being slipped. In addition, the damage of the large diameter cam 32U is prevented.

Note that knots 513, 514 for forming the rings 511, 512 shown in FIG. 8 are also preferably arranged at the position separated from the large diameter cam 32U for preventing the damage of the large diameter cam 32U and uniformizing the tensile force.

On the other hand, the second high-elasticity raw thread 52 is provided for preventing (suppressing) the cable 50 from slipping at the reel 30L side when the cable 50 is mounted on the reel 30L shown in FIG. 3, FIG. 5 and FIG. 6. As shown in FIG. 6, the second high-elasticity raw thread 52 is wound around the bobbin 35L and the second connection pin 57 by a plurality of times. The winding of the second high-elasticity raw thread 52 is same as the winding of the first high-elasticity raw thread 51 to the bobbin 34U and the first connection pin 56 except for that they are formed symmetrically to each other in the vertical direction. Accordingly, the explanation of the method of winding the second high-elasticity raw thread 52 to the bobbin 35L and the second connection pin 57 will be omitted.

The second high-elasticity raw thread 52 is wound around the bobbin 35L and the second connection pin 57. Thus, the second high-elasticity raw thread 52 connects the bobbin 35L with the second connection pin 57. The bobbin 35L is mounted on the small diameter cam 33L of the reel 30L. In this state, the second high-elasticity raw thread 52 is wound on the groove formed on an outer peripheral surface of the small diameter cam 33L. Consequently, the second high-elasticity raw thread 52 transmits the rotation of the small diameter cam 33L to the second connection pin 57 when the small diameter cam 33L is rotated.

As shown in FIG. 6, the second connection pin 57 has the same shape as the first connection pin 56. As described above, the second high-elasticity raw thread 52 is wound around a columnar portion of the second connection pin 57. Furthermore, although it will be described later, the low-elasticity raw thread 53 is wound around the second connection pin 57. Consequently, the second connection pin 57 connects the second high-elasticity raw thread 52 and the low-elasticity raw thread 53 with each other.

Furthermore, the second connection pin 57 is arranged at a position separated from the small diameter cam 33L. Same as the first connection pin 56, the low-elasticity raw thread 53 is prevented from being wound around the small diameter cam 33L and prevented from being slipped. In addition, the damage of the small diameter cam 33L is prevented.

The first high-elasticity raw thread 51 and the second high-elasticity raw thread 52 are formed of the thread hardly elastically deformed and hardly extended. In detail, the first high-elasticity raw thread 51 and the second high-elasticity raw thread 52 are formed of the thread having low Young's modulus. As a specific example, the first high-elasticity raw thread 51 and the second high-elasticity raw thread 52 are formed of a synthetic fiber formed by polyparaphenylene benzobisoxazole such as the fiber of Zylon (registered trademark). Since the first high-elasticity raw thread 51 and the second high-elasticity raw thread 52 are hardly elastically deformed and hardly extended, when the large diameter cam 32U and the small diameter cam 33L are rotated, they are hardly slipped on the large diameter cam 32U and the small diameter cam 33L. Even if they are slipped, the slip amount is small. As a result, the first high-elasticity raw thread 51 and the second high-elasticity raw thread 52 can transfer the movement (motion) of the large diameter cam 32U and the small diameter cam 33L to the first connection pin 56 and the second connection pin 57 in a state that the energy loss is small.

On the other hand, the low-elasticity raw thread 53 is wound around the first connection pin 56 and the second connection pin 57 by a plurality of times. In detail, as shown in FIG. 9, rings 531, 532 are formed on both ends of the low-elasticity raw thread 53. In the rings 531, 532, the first connection pin 56 is inserted through the ring 531. The low-elasticity raw thread 53 is extended in −Z direction from the ring 531 and wound around the second connection pin 57 shown in FIG. 7. After the low-elasticity raw thread 53 is wound around the second connection pin 57, the low-elasticity raw thread 53 is extended in +Z direction and further wound around the first connection pin 56 as shown in FIG. 9. After the low-elasticity raw thread 53 is repeatedly wound around the second connection pin 57 and the first connection pin 56, the first connection pin 56 is inserted through the ring 532 located at the end portion. Consequently, the low-elasticity raw thread 53 is fixed to the first connection pin 56. As described above, the low-elasticity raw thread 53 is wound around the first connection pin 56 and the second connection pin 57. Note that bending points of the first high-elasticity raw thread 51 and the low-elasticity raw thread 53 are shown by dots in FIG. 9 for facilitating the understanding. This is the same in FIG. 7.

In addition, the position of winding the low-elasticity raw thread 53 is displaced in a cylindrical axial direction of the first connection pin 56 from the previous position each time when the low-elasticity raw thread 53 is wound around the first connection pin 56. The low-elasticity raw thread 53 and the first high-elasticity raw thread 51 are alternately wound in the cylindrical axial direction of the first connection pin 56. Consequently, the application of uneven force to the first connection pin 56 is prevented when the tensile force is applied to the low-elasticity raw thread 53 and the first high-elasticity raw thread 51. In addition, the low-elasticity raw thread 53 and the second high-elasticity raw thread 52 are also alternately wound in the cylindrical axial direction of the second connection pin 57 as shown in FIG. 7. Consequently, the application of uneven force to the second connection pin 57 is prevented.

Furthermore, the low-elasticity raw thread 53 is tensed between the reels 30U, 30L in a state that the bobbin 34U shown in FIG. 6 is mounted on the large diameter cam 32U of the reel 30U and the bobbin 35L is mounted on the small diameter cam 33L of the reel 30L. In addition, the low-elasticity raw thread 53 is wound around a pulley 70. Consequently, the low-elasticity raw thread 53 is arranged along the shape of the bow body 10 in a side view. As a result, the bow body 10 is prevented from being compressed and deformed by the elastic force of the low-elasticity raw thread 53.

On the other hand, the low-elasticity raw thread 53 is formed of the thread easily elastically deformed and easily extended. In detail, the low-elasticity raw thread 53 is formed of the thread having high Young's modulus.

Here, the low-elasticity means that it is more easily elastically deformed and more easily extended than the first high-elasticity raw thread 51 and the second high-elasticity raw thread 52 and the high-elasticity means that it is more hardly elastically deformed and more hardly extended than the low-elasticity raw thread 53 in the specification of the present invention.

In detail, the low-elasticity raw thread 53 is formed of the thread having higher Young's modulus than the first high-elasticity raw thread 51 and the second high-elasticity raw thread 52. For example, the low-elasticity raw thread 53 has Young's modulus more than three times as much as the Young's modulus of either one of the first high-elasticity raw thread 51 and the second high-elasticity raw thread 52. As a specific example, the low-elasticity raw thread 53 is formed of a para-aramid fiber such as the fiber of Technora (registered trademark) or a high-strength polyarylate fiber such as the fiber of Vectran (registered trademark). Consequently, the rotation of the large diameter cam 32U and the small diameter cam 33L is transferred to the low-elasticity raw thread 53 by the first connection pin 56 and the second connection pin 57. As a result, the low-elasticity raw thread 53 is elastically deformed efficiently when it is pulled. Thus, the elastic force is generated for letting the arrow fly.

At this time, the first high-elasticity raw thread 51 and the second high-elasticity raw thread 52 are hardly slipped on the large diameter cam 32U and the small diameter cam 33L. Accordingly, the rotation of the large diameter cam 32U and the small diameter cam 33L is transferred to the low-elasticity raw thread 53 with high efficiency. As a result, the elastic deformation amount of the low-elasticity raw thread 53 becomes larger and the elastic force becomes higher. Consequently, the bow 1 can let the arrow fly to a further distance.

Note that the cable 60 also has a first high-elasticity raw thread 61, a second high-elasticity raw thread 62 and a low-elasticity raw thread 63 same as the cable 50. The configuration of the cable 50 is same as that of the cable 60 except for that (1) symmetrically to the cable 50 in the vertical direction (2) wound around the large diameter cam 32L of the reel 30L and the small diameter cam 33U of the reel 30U shown in FIG. 3 and FIG. 6 (3) wound around a pulley 71 arranged in the right direction of the pulley 70 instead of the pulley 70 arranged at the center in the vertical direction of the bow body 10 (4) wound by using a first connection pin 66 and a second connection pin 67 having the same shape as the first connection pin 56 and the second connection pin 57 instead of the first connection pin 56 and the second connection pin 57 (5) wound around the bobbins 34L 35U having the same shape as the bobbins 34U, 35L instead of the bobbins 34U, 35L. Accordingly, the explanation of the configuration of the cable 60 will be omitted.

As described above, in the bow 1 of the embodiment, the cables 50, 60 have the first high-elasticity raw threads 51, 61 wound around the large diameter cams 32U, 32L and the second high-elasticity raw threads 52, 62 wound around the small diameter cams 33L, 33U. Accordingly, compared to the case where the low-elasticity raw thread is wound around the large diameter cams 32U, 32L and the small diameter cams 33L, 33U, the cables 50, 60 are hardly slipped on the large diameter cams 32U, 32L and the small diameter cams 33L, 33U. As a result, in the bow 1, the rotation of the large diameter cams 32U, 32L and the small diameter cams 33L, 33U is converted into the elastic deformation of the low-elasticity raw threads 53, 63 of the cables 50, 60 with high efficiency. Thus, the energy loss is low. Consequently, the bow 1 can let the arrow fly to a further distance.

In the bow 1, the first connection pins 56, 66 are arranged at the position separated from the large diameter cams 32U, 32L. As a result, the low-elasticity raw threads 53, 63 are connected with the first high-elasticity raw threads 51, 61 at the position separated from the large diameter cams 32U, 32L. Accordingly, the low-elasticity raw threads 53, 63 are prevented from being wound around the large diameter cams 32U, 32L and prevented from being elastically deformed. As a result, the cables 50, 60 are hardly deformed on the large diameter cams 32U, 32L. Similarly, as the result that the second connection pins 57, 67 are arranged at the position separated from the small diameter cams 33L, 33U, the low-elasticity raw threads 53, 63 are separated from the small diameter cams 33L, 33U. Accordingly, the cables 50, 60 are hardly slipped on the small diameter cams 33L, 33U.

Since the first high-elasticity raw threads 51, 61 and the low-elasticity raw threads 53, 63 are connected with each other via the first connection pins 56, 66, the first high-elasticity raw threads 51, 61 and the low-elasticity raw threads 53, 63 can be easily replaced. As a result, maintenance work of the bow 1 is easy. Similarly, since the second high-elasticity raw threads 52, 62 and the low-elasticity raw threads 53, 63 are connected with each other via the second connection pins 57, 67, maintenance work of the bow 1 is easy.

Since the first high-elasticity raw threads 51, 61 and the low-elasticity raw threads 53, 63 are alternately wound in the cylindrical axial direction of the first connection pins 56, 66, uneven force is hardly applied to the first connection pins 56, 66. As a result, lifetime of the first connection pins 56, 66 is long. Similarly, since the second high-elasticity raw threads 52, 62 and the low-elasticity raw threads 53, 63 are alternately wound in the cylindrical axial direction of the second connection pins 57, 67, lifetime of the second connection pins 57, 67 is long.

Although the embodiments of the present invention are explained above, the present invention is not limited to the above described embodiments. In the above described embodiments, the first high-elasticity raw threads 51, 61 and the low-elasticity raw threads 53, 63 are connected with each other via the first connection pins 56, 66. In addition, the second high-elasticity raw threads 52, 62 and the low-elasticity raw threads 53, 63 are connected with each other via the second connection pins 57, 67. However, the present invention is not limited to the above described configuration. In the present invention, it is enough if the first high-elasticity raw threads 51, 61 and the second high-elasticity raw threads 52, 62 are connected with each other by the low-elasticity raw threads 53, 63. The connection form can be arbitrarily determined in the above described configuration. For example, each of the first high-elasticity raw threads 51, 61 and the low-elasticity raw threads 53, 63 can be connected with a ring-shaped metal fitting and they are connected with each other via the metal fitting.

In the above described embodiments, the first high-elasticity raw threads 51, 61 and the second high-elasticity raw threads 52, 62 are formed of a synthetic fiber formed of polyparaphenylene benzobisoxazole, and the low-elasticity raw threads 53, 63 are a para-aramid fiber or a high-strength polyarylate fiber as an example. However, the present invention is not limited to the above described configuration. In the present invention, it is enough if the low-elasticity raw threads 53, 63 are elastically deformed more easily than the first high-elasticity raw threads 51, 61 and the second high-elasticity raw threads 52, 62. In other words, it is enough if the first high-elasticity raw threads 51, 61 and the second high-elasticity raw threads 52, 62 are elastically deformed more hardly than the low-elasticity raw threads 53, 63. For example, the first high-elasticity raw threads 51, 61 and the second high-elasticity raw threads 52, 62 are preferably formed of the material having the higher elastic modulus than the low-elasticity raw threads 53, 63 so that the first high-elasticity raw threads 51, 61 and the second high-elasticity raw threads 52, 62 are hardly deformed.

As a more concrete example, when the low-elasticity raw threads 53, 63 are formed of a para-aramid fiber, the first high-elasticity raw threads 51, 61 and the second high-elasticity raw threads 52, 62 are preferably formed of a carbon fiber.

In addition, the low-elasticity raw threads 53, 63, the first high-elasticity raw threads 51, 61 and the second high-elasticity raw threads 52, 62 can be formed of the same material. In this case, it is enough if the cross-sectional area of the low-elasticity raw threads 53, 63 is smaller and the cross-sectional area of the first high-elasticity raw threads 51, 61 and the second high-elasticity raw threads 52, 62 is larger. In addition, it is also possible that the cross-sectional area is specified to be almost the same and the number of winding the low-elasticity raw threads 53, 63 is made smaller and the number of winding the first high-elasticity raw threads 51, 61 and the second high-elasticity raw threads 52, 62 is made larger. As described above, whether the threads are the low-elasticity raw threads 53, 63 or the first high-elasticity raw threads 51, 61 and the second high-elasticity raw threads 52, 62 can be determined by the elastic modulus of the material of the raw thread or determined by the structure of the raw thread or the number of winding the raw thread. Note that the elastic modulus is also referred to as an elastic coefficient or an elastic constant. Specifically, the elastic modulus means a tensile elastic modulus or a Young's modulus.

In the above described embodiments, the explanation is made in condition that the arrow is shot while directing the string 40 in the vertical direction. However, the present invention is not limited to the above described configuration. In the present invention, the direction of the string 40 when shooting the arrow can be arbitrarily determined. The arrow can be shot from the bow 1 while the string 40 is inclined. Since the direction of the string 40 can be arbitrarily determined, the upper end and the lower end of the bow body 10 can be also referred to as one end and the other end.

DESCRIPTION OF THE REFERENCE NUMERALS

1: bow
10: bow body
20U, 20L: holder
30U, 30L: reel
31U, 31L: string cam
32U, 32L: large diameter cam
33U, 33L: small diameter cam
34U, 34L, 35U, 35Lb: bobbin
36, 37: disk-shaped lid
40: string
50, 60: cable
51, 61: first high-elasticity raw thread
52, 62: second high-elasticity raw thread
53, 63: low-elasticity raw thread
56, 66: first connection pin
57, 67: second connection pin
70, 71: pulley
101: notch
201: notch
202R, 202L: plate
203: connecting rod
204R, 204L: bearing
205: rotary shaft
511, 512: ring
513, 514: knot
531, 532: ring
RL, RU: direction
SH: shaft hole

What is claimed is:

1. A cable of a bow, the bow comprising:

a pair of string cams around which a string for nocking an arrow are wound so that the pair of string cams are rotated when the string is drawn; and a pair of cable cams configured to be rotated integrally with each of the pair of string cams, the cable being tensed between the pair of cable cams and configured to be elastically deformed to generate an elastic force for rotating the pair of cable cams and the pair of string cams rotated integrally with the pair of cable cams in a reverse direction when the string is drawn to rotate the pair of cable cams, the cable comprising:

a first high-elasticity raw thread wound around one of the pair of cable cams;

a second high-elasticity raw thread wound around the other of the pair of cable cams;

a low-elasticity raw thread which connects the first high-elasticity raw thread with the second high-elasticity raw thread, the low-elasticity raw thread being elastically deformed more easily than the first high-elasticity raw thread and the second high-elasticity raw thread;

a first connection pin for connecting the first high-elasticity raw thread with the low-elasticity raw thread by winding the first high-elasticity raw thread and the low-elasticity raw thread around the first connection pin; and a second connection pin for connecting the second high-elasticity raw thread with the low-elasticity raw thread by winding the second high-elasticity raw thread and the low-elasticity raw thread around the second connection pin.

2. The cable according to claim 1, wherein the low-elasticity raw thread is connected with the first high-elasticity raw thread at a position separated from the one of the pair of cable cams and connected with the second high-elasticity raw thread at a position separated from the other of the pair of cable cams.

3. The cable according to claim 1, wherein the first high-elasticity raw thread and the low-elasticity raw thread are alternately wound in an axial direction of the first connection pin, and the second high-elasticity raw thread and the low-elasticity raw thread are alternately wound in an axial direction of the second connection pin.

4. A bow comprising:

a pair of string cams around which a string for nocking an arrow are wound so that the pair of string cams are rotated when the string is drawn; and a pair of cable cams around which a cable are wound so that the pair of cable cams is configured to be rotated integrally with each of the pair of string cams, the cable comprising:

a first high-elasticity raw thread wound around one of the pair of cable cams;

a second high-elasticity raw thread wound around the other of the pair of cable cams;

a low-elasticity raw thread which connects the first high-elasticity raw thread with the second high-elasticity raw thread, the low-elasticity raw thread being elastically deformed more easily than the first high-elasticity raw thread and the second high-elasticity raw thread;

a first connection pin for connecting the first high-elasticity raw thread with the low-elasticity raw thread by winding the first high-elasticity raw thread and the low-elasticity raw thread around the first connection pin; and a second connection pin for connecting the second high-elasticity raw thread with the low-elasticity raw thread by winding the second high-elasticity raw thread and the low-elasticity raw thread around the second connection pin, wherein the cable is configured to be elastically deformed to generate an elastic force for rotating the pair of cable cams and the pair of string cams rotated integrally with the pair of cable cams in a reverse direction when the string is drawn to rotate the pair of cable cams.

* * * * *